US005220383A

United States Patent [19]

Enoki et al.

[11] Patent Number: 5,220,383

[45] Date of Patent: Jun. 15, 1993

[54] DEVELOPING DEVICE FOR AN IMAGE FORMING APPARATUS HAVING A LARGE NUMBER OF MICROFIELDS FORMED ON A DEVELOPER CARRIER

[75] Inventors: Shigekazu Enoki, Kawasaki; Koji Suzuki, Yokohama; Naoki Iwata, Tokyo; Yuichi Ueno, Kawasaki; Junko Tomita, Tokyo, all of Japan

[73] Assignee: Ricoh Company, Ltd., Tokyo, Japan

[21] Appl. No.: 861,997

[22] Filed: Apr. 1, 1992

[30] Foreign Application Priority Data

Apr. 1, 1991 [JP] Japan ..... 3-96459
Apr. 13, 1991 [JP] Japan ..... 3-108655

[51] Int. Cl.[5] ..... G03G 21/00

[52] U.S. Cl. ..... 355/246; 118/651; 118/653; 118/656; 355/259

[58] Field of Search ..... 355/245, 246, 251, 253, 355/259, 261, 262; 118/647, 648, 651, 653, 656–658

[56] References Cited

U.S. PATENT DOCUMENTS

| | | | |
|---|---|---|---|
| 3,203,394 | 8/1965 | Hope et al. | 355/259 X |
| 3,759,222 | 9/1973 | Maksymiak et al. | 355/259 X |
| 3,999,515 | 12/1976 | Weiler | 118/651 X |
| 4,114,261 | 9/1978 | Weiler | 118/651 X |
| 4,295,443 | 10/1981 | Kohyama | 118/657 |
| 4,425,382 | 1/1984 | Tajima | 118/657 X |
| 4,515,106 | 5/1985 | Kohyama | 118/651 |
| 4,930,438 | 6/1990 | Demizu et al. | 118/651 |

*Primary Examiner*—A. T. Grimley
*Assistant Examiner*—William J. Royer
*Attorney, Agent, or Firm*—Oblon, Spivak, McClelland, Maier & Neustadt

[57] ABSTRACT

A developing device incorporated in an image forming apparatus and including a developing roller or similar developer carrier for transporting a developer to a developing region where it faces an image carrier, so as to develop a latent image electrostatically formed on the image carrier. The developer carrier has a first and a second substance different in charging characteristic from each other and exposed to the outside on the surface of the developer carrier in a regular or irregular pattern. At least one of the first and second substances is charged to predetermined polarity on the surface of the developer carrier to form a great number of microfields. Alternatively, the developer carrier may have a conductive base and a surface layer provided on the base and constituted by a conductive substance in which insulating particles are dispersed. At least the insulating particles are charged on the surface of the developer carrier to form a number of microfields. The movement of the developer is controlled by an electric field determined by a relation of a potential deposited on the image carrier, an electric field ascribable to the bias applied from a bias applying source, and an electric field developed on the developer carrier.

17 Claims, 10 Drawing Sheets

DEVELOPING DEVICE FOR AN IMAGE FORMING APPARATUS HAVING A LARGE NUMBER OF MICROFIELDS FORMED ON A DEVELOPER CARRIER

BACKGROUND OF THE INVENTION

The present invention relates to a developing device for an electrophotographic copier, printer, facsimile transceiver or similar image forming apparatus and, more particularly, to a developing device having a developing roller or similar image carrier for transporting a developer to a developing station where the image carrier faces an image carrier, thereby developing a latent image electrostatically formed on the image carrier.

A conventional developing apparatus for the above application has a developing roller or similar developer carrier for carrying a thin layer of developer thereon and facing a photoconductive element or similar image carrier at a developing station. An electric field is developed at the developing station to transfer the developer from the developing roller to the photoconductive element, thereby developing an electrostatic latent image formed on the photoconductive element. In this type of developing device, a threshold value exists regarding the transfer of the developer from the developing roller to the photoconductive element. This brings about a problem that the developed image has poor tonality since the developer scarcely deposits in an image portion whose surface potential is lower than the threshold value, although it deposits in an image portion whose surface potential is higher than the threshold value. To eliminate this problem, an alternating electric field of relatively low frequency may be formed at the developing station, as disclosed in, for example, Japanese Patent Publication No. 1013/1989. However, when such an alternating electric field is simply applied to the developing station, conditioning the electric field for higher tonality lowers the image density while conditioning it for higher image density unwantedly increases the width of lines of an image.

Moreover, when the above-described type of developing device is operated with developer in the form of a non-magnetic toner, the toner forms powder clouds when moved back and forth between the developing roller and the photoconductive element, lowering the image density to a critical extent (see Japanese Patent Publication No. 14706/1990, for example).

SUMMARY OF THE INVENTION

It is therefore an object of the present invention to provide a developing device which insures high image quality, i.e., high image density and high reproducibility of lines.

In accordance with the present invention, a developing device incorporated in an image forming apparatus for developing a latent image electrostatically formed on an image carrier by a developer in a developing region has a bias source for applying a bias to the developing region, and a developer carrier for transporting the developer. The developer carrier has a first and a second substance different in charging characteristic from each other and exposed to the outside on the surface of the developer carrier in a regular or irregular pattern. At least one of the first and second substances is charged to a predetermined polarity on the surface of the developer carrier to form a great number of microfields on the surface of the developer carrier. The movement of the developer is controlled by an electric field determined by a relation of a potential deposited on the image carrier, an electric field ascribable to the bias applied from the bias source, and an electric field developed on the developer carrier.

Also, in accordance with the present invention, a developing device incorporated in an image forming apparatus for developing a latent image electrostatically formed on an image carrier by a developer in a developing region has a bias source for applying a bias to the developing region, and a developer carrier for carrying the developer. The developer carrier has a conductive base and a surface layer provided on the conductive base and constituted by a conductive substance in which insulating particles are dispersed. At least the insulating particles are charged on the surface of the developer carrier to form a number of microfields on the surface of the developer carrier. The movement of the developer is controlled by an electric field determined by a potential deposited on the image carrier, an electric field ascribable to the bias applied by the bias source, and an electric field developed on the developer carrier.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
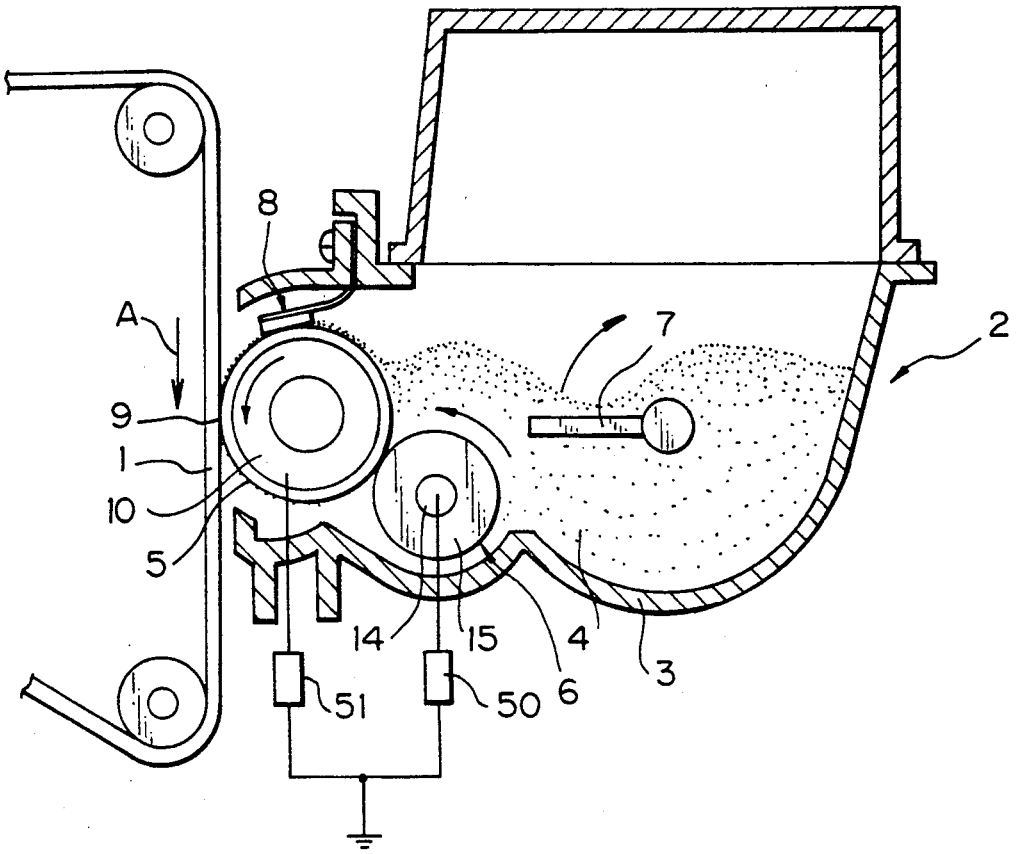
FIG. 1 is a sectional side elevation showing a developing device embodying the present invention.

Referring to FIG. 1 of the drawings, a developing device embodying the present invention is shown and applied to an electrophotographic copier by way of example. As shown, the developing device, generally 2, is located to face a photoconductive belt 1 which is a specific form of an image carrier and rotatable in a direction indicated by an arrow A in the figure. The developing device 2 has a casing 3 storing a non-magnetic toner, or one-component type developer, 4 with or without an auxiliary agent added thereto. The toner 4 has a volume resistivity of, for example, $10^7$–$10^{12}$ Ωcm. A developing roller, or developer carrier, 5 is journalled to opposite side walls of the casing 3 and partly exposed to the outside via an opening formed through the casing. Facing the belt 1, the developing roller 5 is rotated counterclockwise as viewed in the figure. The developer carrier may be implemented as a belt, if desired. A toner supply roller 6 is a specific form of a charging member and also journalled to the side walls of the casing 3. The toner supply roller 6 is rotated counterclockwise in contact with the developing roller 5. An agitator 7 is rotated clockwise to convey the toner in the casing 3 to the toner supply roller 6 while agitating it. The toner supply roller 6, in turn, feeds the toner to the developing roller 5. At this instant, the toner is charged by friction to a predetermined polarity which, in the embodiment, is the same as the polarity of uniform charge deposited on the belt 1. As a result, the toner is electrostatically adhered to the periphery of the developing roller 5. A construction and an operation relating to the deposition of toner will be described specifically later.

While the toner is transported by the developing roller 5 which is in rotation, a doctor blade 8 regulates the toner layer on the roller 5 to a predetermined thickness. The thickness of the toner layer may be matched to the gap between the surface of the belt 1 and the surface of the developing roller 5 or may be smaller than the gap to form a clearance between the toner layer and the surface of the roller 5. When a clearance is formed between the toner layer and the developing roller 5, there will be effected so-called non-contact development. The developing roller 5 further transports the toner to a developing region 9 where the belt 1 and roller 5 face each other. In the developing region 9, the toner is electrostatically transferred from the developing roller 5 to a latent image electrostatically formed on the belt 1, thereby developing the latent image to produce a toner image. The doctor blade 8 may be replaced with any other suitable layer regulating member, e.g., a roller or a belt, as needed. The toner passed the developing region 9 without joining in the development is returned to the toner supply roller 6 by the developing roller 5. The toner image formed on the belt 1 is transferred to a paper sheet or similar recording medium, not shown, and then fixed on the medium by a fixing device, not shown.

Figure 3A:
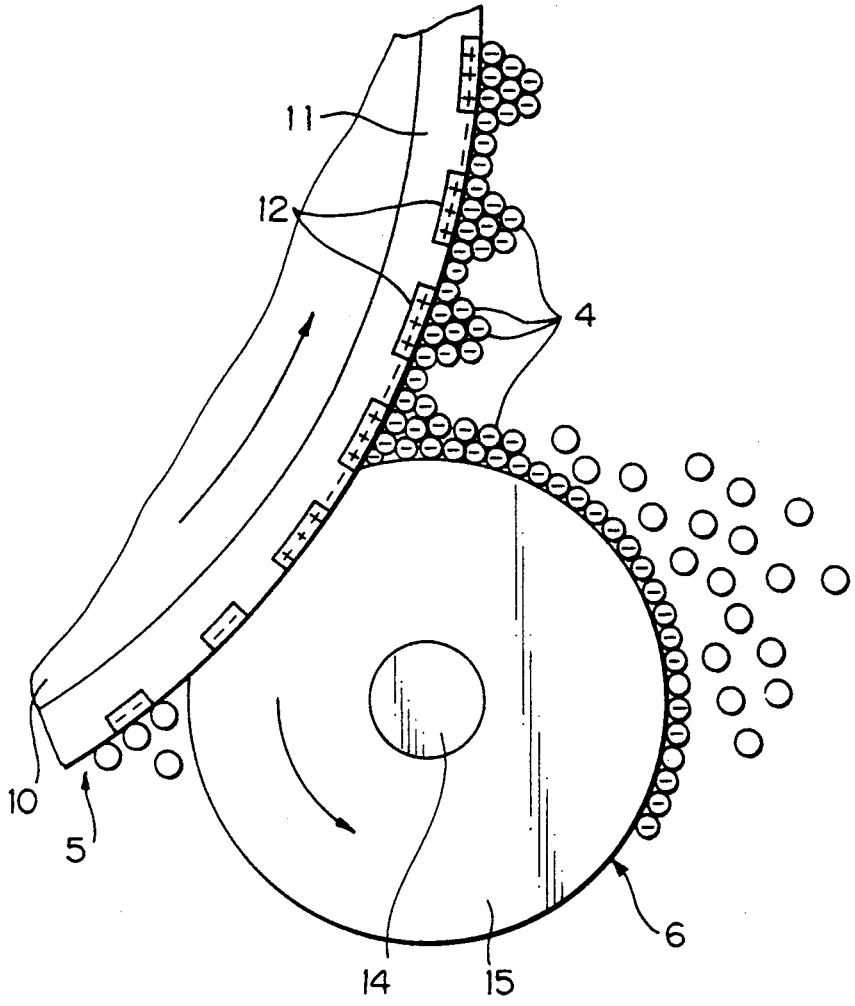
FIG. 3A is a schematic enlarged representation of the dielectric bodies shown in FIG. 2 and toner particles.
Figure 3B:
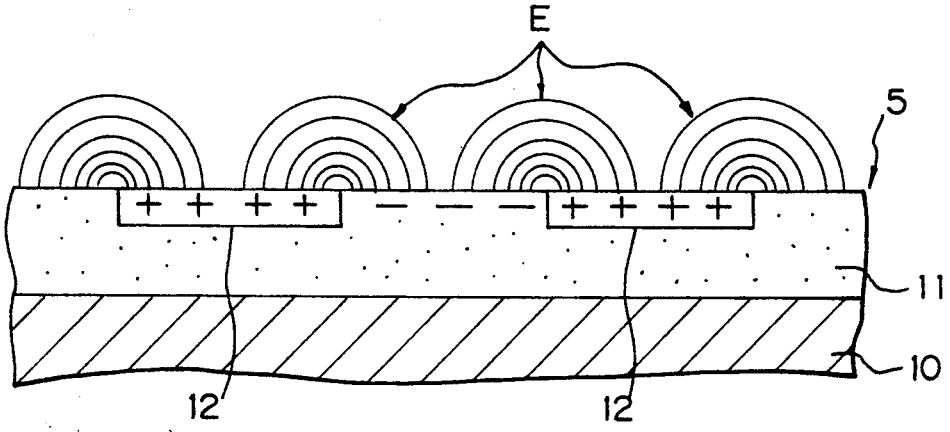
FIG. 3B indicates the electric forces of microfields developed in the vicinity of the surface of the developing roller.

As shown in FIGS. 3A and 3B, the developing roller 5 has a base 10 made of aluminum, iron, copper or similar conductor. A first dielectric body 11 is provided in a layer on the surface of the base 10 while a great number of second dielectric bodies 12 are buried in the first dielectric body 11. The second dielectric bodies 12 are distributed over the surface of the first dielectric body 11 in a regular or irregular pattern, and each has an extremely small area. The dielectric bodies 11 and 12 each has a particular charging characteristic and is sufficiently remote from the other with respect to the frictional charge series. For example, the first dielectric body 11 is made of polystyrene resin and applied to the conductive body 10 to a thickness of about 500 μm, and the second dielectric bodies 12 are made of silicone resin sufficiently remote from polystyrene resin with respect to the frictional charge series and provide on the surface of the dielectric body 11 in a thickness of, for example, about 500 μm. In such a case, the dielectric bodies 12 may each have an area of 200 μm square. Burying one of the two kinds of dielectric bodies in the other is not limitative and may be replaced with a regular or irregular arrangement of the dielectric bodies 11 and 12 made of the above-mentioned substances on the conductive base 10.

Figure 2:
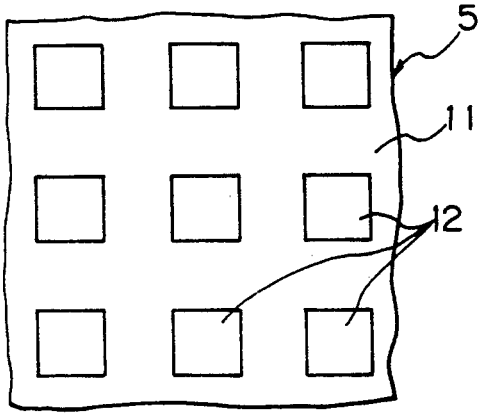
FIG. 2 is an enlarged plan view schematically showing dielectric bodies buried in a developing roller which is included in the embodiment.

FIG. 2 shows a specific configuration of the surface of the developing roller 5. As shown, the second dielectric bodies 12 have a square shape and are arranged regularly at a predetermined pitch. The surface configurations and sizes of the dielectric bodies 11 and 12 may be suitably selected in consideration of, among others, the intensity of microfields which will be described later. It is desirable to provide portions for repulsing the toner, as will be described, with a total area which is 5–40% of the total area of the surface of the developing roller 5.

The toner supply roller 6 contacting the developing roller 5 charges the first and second dielectric bodies 11 and 12 to opposite polarities, so that the positively or negatively charged toner (negatively charged toner in the embodiment) may deposit thereon. For this purpose, the toner supply roller 6 is formed of a material which is intermediate between the dielectric bodies 11 and 12 with respect to the frictional charge series. In the illustrative embodiment, as shown in FIG. 3A, the toner supply roller 6 is made up of a conductive core member 14 and a hollow cylindrical foam body 15 surrounding the core member 14. The foam body 15 is pressed against the developing roller 5 while elastically deforming itself. In such a toner supply roller, the foam body 15 is made of a material intervening between the dielectric bodies 11 and 12 with respect to the frictional charge series, e.g., polyurethane resin. Then, since polystyrene resin and silicone resin are respectively charged to negative and positive polarities, the toner supply roller 6 charges the dielectric body 11 to negative polarity and the dielectric bodies 12 to positive polarity by friction. The foam body 15 may be replaced with any other conventional implementation such as a fur brush constituted by fibers of polyurethane.

In operation, the toner returned to the toner supply roller 6 by way of the developing region 9 as stated above is brought into contact with the roller 6 and then scraped off by a scavenging force exerted by the roller 6. At the same time, the dielectric bodies 11 and 12 of the developing roller 5 are charged to opposite polarities by the friction thereof with the toner supply roller 6. On the other hand, the toner being conveyed toward the developing roller 5 in contact with the toner supply roller 6 is negatively charged by friction by the roller 6. Then, this part of the toner is further negatively charged by contacting the developing roller 5.

Figure 6A:
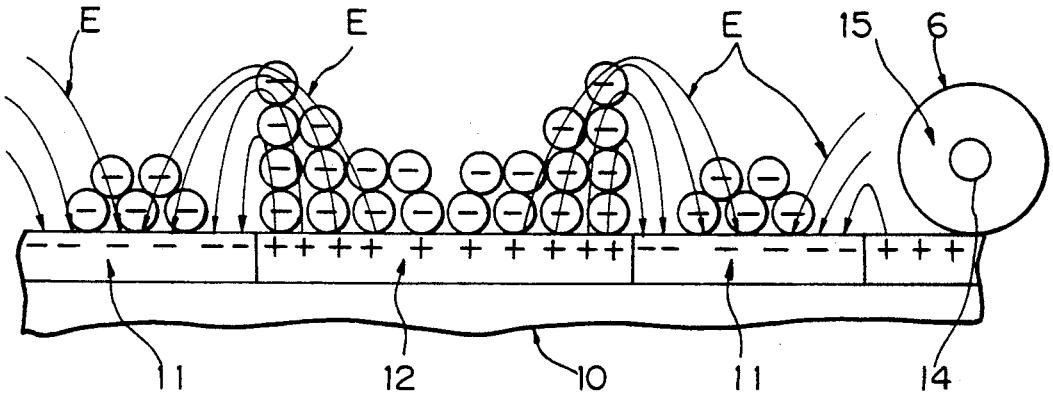
FIGS. 6A–6D are schematic enlarged sectional representations of the electric forces of microfields and toner particles each being attainable with dielectric bodies made of particular materials and a toner supply roller made of a particular material.

Since the dielectric bodies 11 and 12 are charged to opposite polarities, a potential difference is developed between the dielectric bodies 11 and 12 and distributed in a great number in the small area. As a result, closed fields are formed between the dielectric bodies 11 and 12, as indicated by E in FIG. 3B. More specifically, a great number of microfields are formed on the surface of the developing roller 5. Since the surfaces of the dielectric bodies 11 and 12 have small areas and adjoin each other, the microfields are each noticeably intensified by the edge effect or the fringing effect. The toner charged to a predetermined polarity is attracted onto the surface of the developing roller 5 by the microfields E, especially by the dielectric bodies charged to opposite polarity to the toner (second dielectric bodies 12 made of silicone resin in the embodiment), as shown in FIG. 6A. As a result, a great amount of toner is firmly retained on the developing roller 5. Since the toner is intensely charged due to the friction of the toner supply roller 6 and developing roller 5 and, in addition, retained on the roller 5 by the intense microfields, a great amount of toner having a high charge is deposited on the roller 5. While in the embodiment the exposed portions of the second dielectric bodies 12 and those of the first dielectric body 11 are respectively the portions for attracting the toner and the portions for repulsing it, the toner is likely to deposit at the center of each exposed portion of the dielectric body 11 also, as shown in FIG. 6A.

The toner supply roller 6 serves not only to charge the dielectric bodies of the developing roller 5 and the toner but also to supply the toner to the developing roller 5. At this instant, the toner is strongly retained on the developing roller 5 by the microfields developed between the dielectric bodies 11 and 12.

Assume that the doctor blade 8 is made of polyurethane resin. Then, while the sufficiently charged toner is intensely retained on the developing roller 5 due to the microfields, the toner short of charge is removed by the doctor blade 8. As a result, only the sufficiently charged toner is transported to the developing region 9 in a greater amount than conventional to develop a latent image formed on the belt 1. Specifically, it is possible to convey a great amount of toner (e.g. at least 0.8–1.3 mg/cm$^2$) charged to about −5–20 (preferably 8–15) μc/g to the developing region 9 in order to reduce the contamination of the background and to enhance the sharpness of the toner image. It follows that the linear velocity of the surface of the developing roller 5 can be brought close or made equal to that of the belt 1 without reducing the image density. This is true regardless of the color of the toner.

To control the intensity of the microfields on the developing roller 5, a bias voltage may be applied from a power source 50, FIG. 1, to the toner supply roller 6 to thereby deposit a charge on the developing roller 5 by charge injection or discharge. In such a case, the portion of the toner supply roller 6 that contacts the developing roller 5, e.g., a fur brush should be provide with conductivity. Such an arrangement allows the amount of toner to be transported to the developing region 9 to be so controlled as to form a toner image of any desired quality. For example, when the fur brush of the toner supply roller 6 that contacts the developing roller 5 is constituted by fibers of polyurethane, as stated earlier, it is treated to have conductivity and provided with a volume resistivity of, for example, $10^4$–$10^5$ Ω cm.

In FIG. 1, the reference numeral 51 designates a power source for applying a bias voltage to the conductive base 10 of the developing roller 5. To free the background of a toner image from contamination, the bias voltage is implemented by DC or AC-superposed DC.

A reference will be made to FIGS. 7A–9B for describing a specific procedure for applying a bias voltage to the developing roller 5 from the power source 51. In the specific procedure, the belt 1 is made of OPC and provided with a surface potential of −900 V is the background and a potential of −100 V in the exposed area. Use is made of a negatively chargeable toner for reversal development. In the developing roller 5, the first dielectric body 11 and the second dielectric bodies 12 are made of polystyrene resin and silicone resin, respectively. The surface of the toner supply roller 6 is made of polyurethane resin. As shown in FIG. 6A, the dielectric body 11 contacting the toner supply roller 6 holds a charge which sets up a potential of −80 V with respect to the ground potential, while the dielectric bodies 12 also contacting the roller 6 hold a charge which sets up of potential of 200 V. The power source 5 applies to the developing roller 51 a pulse voltage having a peak-to-peak (P—P) voltage of 1000 V, maximum potential of 0 V, frequency of 500 Hz, and duty ratio of 30% ($T_2/T_1$).

Figure 7A:
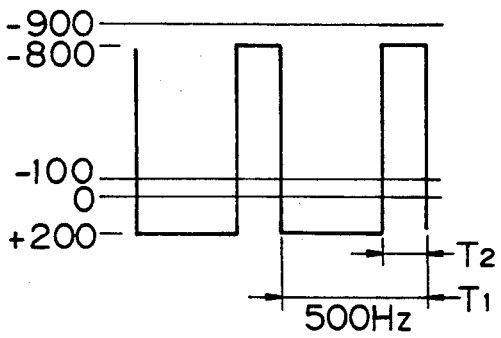
FIGS. 7A and 7B each shows the variation of a potential deposited on the second dielectric body under a particular condition.
Figure 7B:
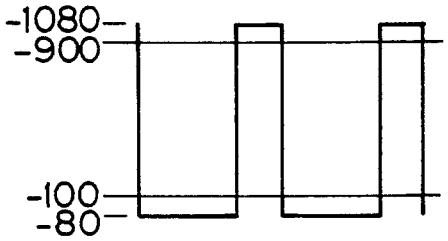

FIGS. 7A and 7B show respectively the variation of the surface potential of the second dielectric bodies 12 with respect to time and the variation of the surface potential of the first dielectric body 11, taking the ground potential as a reference. In FIG. 7A, there are indicated the level of the background surface potential of the belt 1 (−900 V) and the level of the surface potential of the exposed area (−100 V) by horizontal lines. The surface potential of the second dielectric bodies 12 is offset by +200 V due to the charge held by the voltage from the power source 51, as indicated by a rectangular continuous line shown in FIG. 7A. On the other hand, the surface potential of the first dielectric body 11 is offset by −80 V due to the charge held by the voltage from the power source 51, as indicated by a rectangular continuous line in FIG. 7B.

Hereinafter will be described an electric field to appear between the developing roller 5 and the belt 1 in association with the variations of the potentials on the roller 5. The electric field differs from the second dielectric fields 12 to the first dielectric field 11 of the developing roller 5 and from the image area to the background of the belt 1.

Figure 8A:
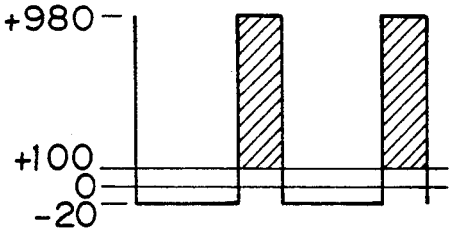
FIGS. 8A and 8B each shows the variation of an electric field for development formed on the first dielectric body under a particular condition.
Figure 8B:
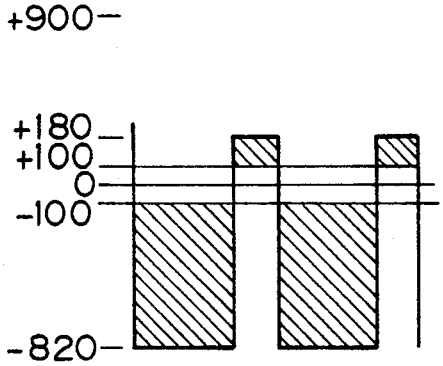
Figure 9A:
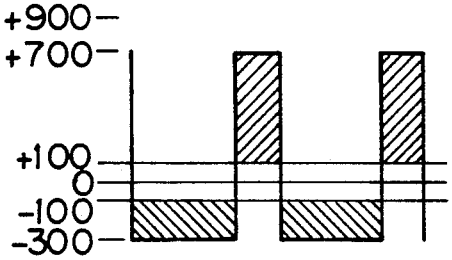
FIGS. 9A and 9B each shows the variation of an electric field for development formed on the second dielectric body under a particular condition.
Figure 9B:
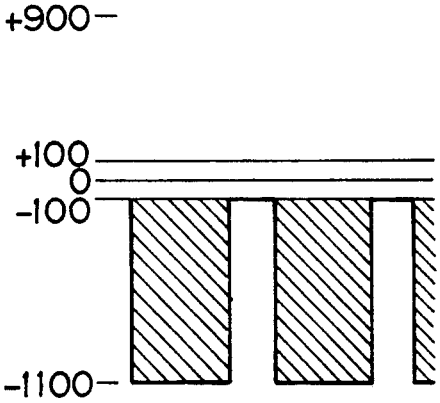

FIGS. 8A and 8B illustrate the electric field on the first dielectric body 11 whose surface potential varies as shown in FIG. 7B. Specifically, FIG. 8A shows the variation of potential difference between the dielectric body 11 and the belt 1 occurring when the dielectric body 11 faces the image area (exposed area) of the belt 1. FIG. 8B shows the variation of potential difference between the dielectric body 11 and the belt 1 occurring when the former faces the background (unexposed area) of the latter. FIGS. 9A and 9B pertain to the electric field on the second dielectric bodies which varies as shown in FIG. 7A. Specifically, FIG. 9A shows the variation of potential difference between the dielectric bodies 12 and the belt observed when the former faces the image area (exposed area) of the latter, while FIG. 9B shows the variation of the potential difference between the dielectric bodies 12 and the belt 1 observed when the former faces the background (unexposed area) of the latter.

The electric field exerts an electrostatic force on the toner carried on the surface of the developing roller 5 or the surface of the belt 1. For this reason, in FIGS. 8A, 8B, 9A and 9B, the potential difference corresponding to the electric field which moves the toner toward the belt 1 and the potential difference corresponding to the electric field which moves it toward the developing roller 5 are represented by a positive sign and a negative sign, respectively, in order to distinguish the directions of the electrostatic force. Experiments showed that the threshold of the potential difference transferring the toner from the developing roller 5 to the belt 1 and the threshold of the electric field transferring it from the belt 1 to the developing roller are respectively +100 V and −100 V, as indicated by horizontal lines in the above figures. Hatching indicates portions corresponding to an electric field which contributes to the toner transfer beyond the thresholds.

For the above experiments, the developing roller 5 and the belt 1 were spaced apart by a gap of 100 μm, and a DC voltage was applied to the roller 5 and changed to see the transfer of the toner. In this specific case, the threshold of the electric field for development was measured to be 1 V/μm while the charge deposited on the toner was found to be about 10 μC/g.

Presumably, when the toner existing on the first dielectric body 11 of the developing roller 5 faces the image area of the belt 1, it is transferred toward the belt 1 when an electric field for developing corresponding to the potential difference of +980 V is set up, as indicated by hatching in FIG. 8A. When such a toner faces the background of the belt 1, it is transferred again to the developing roller 5 since a negative electric field of −820 V and a positive electric field of +180 V appear alternately as electric fields that contribute to the toner transfer. This is presumably because although the positive electric field and the negative electric field transfer the toner from the roller 5 to the belt 1 and from the belt 1 to the roller 5, respectively, the duration of the transfer from the belt 1 to the roller 5 is sufficiently long and the transferring force is great during such a period of time. As a result, the toner is again transferred to the developing roller 5 although some toner may be moved toward the belt 1 by the positive electric field.

Likewise, when the toner existing on the second dielectric bodies 12 faces the image area of the belt 1, a negative electric field of −300 V and a positive electric field of +700 V appear alternately, as indicated by hatching in FIG. 9A, since the dielectric bodies 12 are originally charged to +200 V. Presumably, such a toner is transferred from the developing roller 5 to the belt 1 by the positive electric field and from the belt 1 to the developing roller 5 by the negative electric field. When the toner on the second dielectric bodies 12 face the background of the belt 1, it presumably is transferred from the belt 1 to the developing roller 5 by a negative electric field of −1100 V and not transferred back and forth between the belt 1 and the roller 5.

In the embodiment, regions each holding a particular charge are distributed over the surface of the developing roller 5 and a different bias voltage for development is locally applied in the developing region. Hence, when a bias voltage is to be applied to between the belt 1 and the developing roller 5 to effect development, the transfer of the toner can be controlled by the developing roller 5. For example, a positive and a negative electric field exceeding respective thresholds, as shown in FIG. 9A, act on the toner existing on the second dielectric bodies 12, preventing an excessive amount of toner from being deposited. The toner existing on the first dielectric body 11 can be provided with a higher developing ability than the toner existing on the second dielectric bodies 12 due to the electric field shown in FIG. 8A. Such a bias can be so selected as to achieve a desired image by changing the charges to be held by the dielectric bodies, e.g., by changing the materials of the dielectric bodies.

The first dielectric body 11 may be made of Teflon (trade name) resin in place of polystyrene resin. Such a dielectric body will also be charged to negative polarity opposite to the polarity of the second dielectric bodies 12, which are made of silicone resin, by the toner supply roller 6 made of polyurethane resin, causing the dielectric bodies 12 to attract the negatively charged toner.

Figure 6B:
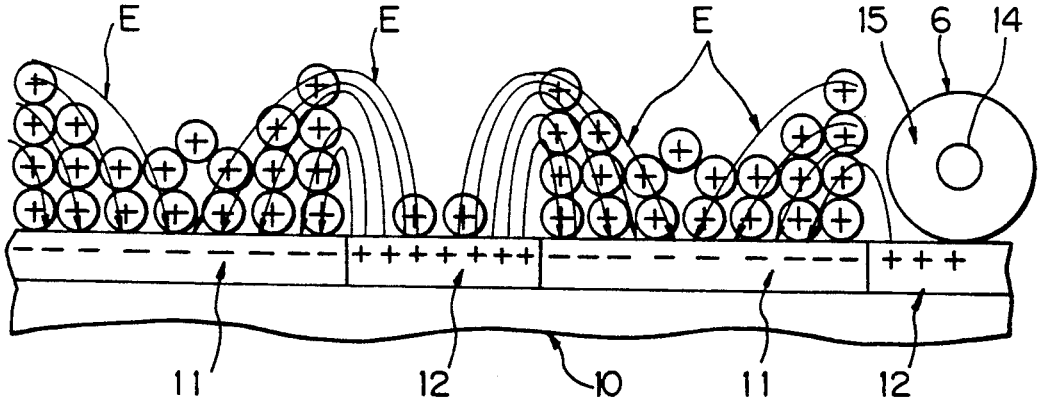

When the toner is negatively charged, the first dielectric body 11, the second dielectric bodies 12 and the foam body, for example, of the toner supply roller 6 may be made of polycarbonate resin. Teflon resin, and urethane or polystyrene resin, respectively. In such a case, the dielectric body 11 will be positively charged while the second dielectric bodies 12 will be negatively charged. The resulting microfields between the dielectric bodies 11 and 12 will cause the toner to be attracted mainly by the dielectric body 11. Conversely, use may be made of a positively chargeable toner. Then, the dielectric body 11 and the dielectric bodies 12 may be respectively made of Teflon resin and polycarbonate resin (the toner supply roller 6 is again made of polyurethane or polystyrene). FIG. 6B shows how the toner is deposited on the surface of such a developing roller 5; the positively charged toner is attracted mainly by the dielectric body 11 made of Teflon resin and charged to negative polarity.

In the above embodiment, the first and second dielectric bodies 11 and 12 are charged to opposite polarities to form numerous microfields on the surface of the developing roller 5. Such microfields are also achievable even when either of the first and second dielectric bodies 11 and 12 is positively or negatively charged by friction. For example, when only the second dielectric bodies 12 are charged, the toner supply roller 6 contacting the developing roller 5 is made of a material which is sufficiently remote from the dielectric bodies 12 and coincident or substantially coincident with the first dielectric body 11 with respect to the frictional charge series. Of course, the first and second dielectric bodies 11 and 12 should be sufficiently remote from each other with respect to the frictional charge series.

In the above configuration, the second dielectric bodies 12 remote from the toner supply roller 6 with respect to the frictional charge series are intensely charged to a predetermined polarity which is determined by the charge series. On the other hand, the first dielectric body 11 coincident or substantially coincident with the toner supply roller with respect to the frictional charge series is not charged at all or substantially not charged. The resulting potential difference between the dielectric bodies 11 and 12 is distributed in numerous positions within the small area. Hence, numerous microfields E, FIG. 3B, are developed on the surface of the developing roller 5 and noticeably intensified by the edge effect or the fringing effect, as previously stated.

Figure 6C:
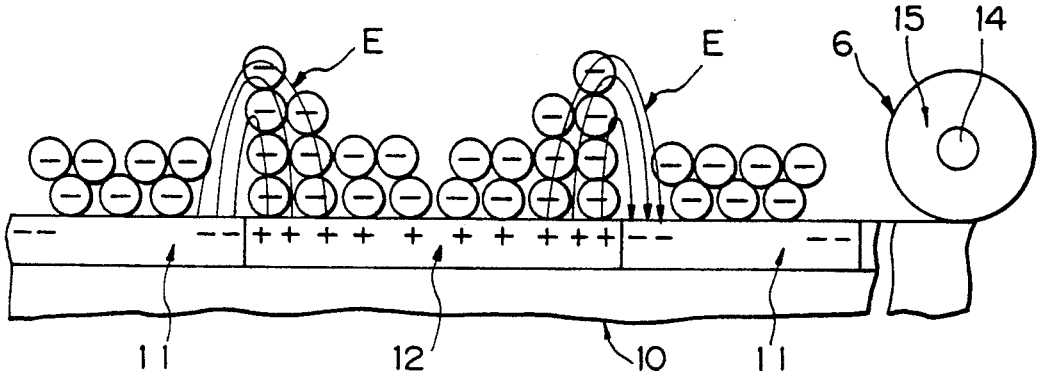

For example, the first dielectric body 11, the second electric body 12 and the foam body 15 of the toner supply roller 6 are made of polystyrene resin, polycarbonate resin, and polyurethane or polystyrene resin, respectively. The foam body 15 may be replaced with, for example, a fur brush constituted by urethane fibers. In this example, only the second dielectric bodies 12 may be positively charged by friction to attract the negatively charged toner intensely onto the dielectric bodies 12 by the resulting microfields. In FIG. 6C, the sign "−" located at the boundary portions of the first electric body 11 adjoining the second dielectric bodies 12 is indicative of a small amount of negative charge induced in the boundary portions due to the frictional charge of the dielectric bodies 12. Such a small amount of charge and the charge of the dielectric bodies 12 generate microfields. The toner is also deposited in the central area of the first dielectric body 11. Hence, the developing roller 5 carries the toner intensely attracted by the second dielectric bodies 12 and the toner comparatively weakly attracted by the first dielectric body 11.

In the above embodiment, an arrangement may be made such that the toner is positively charged and mainly attracted onto the surface of the first dielectric body 11.

In the embodiment, the toner supply roller 6 is made of a substance substantially coincident with the first dielectric body 11 and different from the second dielectric bodies 12 with respect to the frictional charge series. If desired, the toner supply roller 6 may be made of a substance substantially coincident with the second dielectric bodies 12 and different from the first dielectric body 11 with respect to the frictional charge series. For example, assuming that the toner is positively charged, the toner supply roller 6 may be implemented as a fur brush constituted by polyurethane fibers or a roller made of such a material, the first dielectric body 11 may be made of Teflon resin, and the second dielectric bodies 12 may be made of polystyrene resin close to polyurethane with respect to the frictional charge series. Then, the exposed portions of the dielectric body 1 will be negatively charged while the exposed portions of the dielectric bodies 12 will not be charged since it is close to the material of the toner supply roller 6. In such a condition, microfields will be formed between the dielectric bodies 11 and 12 to implement the previously stated function. In this case, the toner supply roller 6 may be constituted by a roller made of polystyrene.

Assuming that the toner is negatively charged, use may be made of a toner supply roller 6 in the form of a fur brush or roller made of Teflon resin, one dielectric body made of silicone resin, and the other dielectric body made of Teflon resin. Then, microfields will be developed between the dielectric body made of silicone and positively charged by the roller 6 and the dielectric body made of Teflon and substantially not charged, causing the toner to be mainly attracted by the dielectric body made of silicone resin. The gist is that at least one of the two kinds of dielectric bodies each having a particular charging characteristic should be charged by the charging member.

Figure 6D:
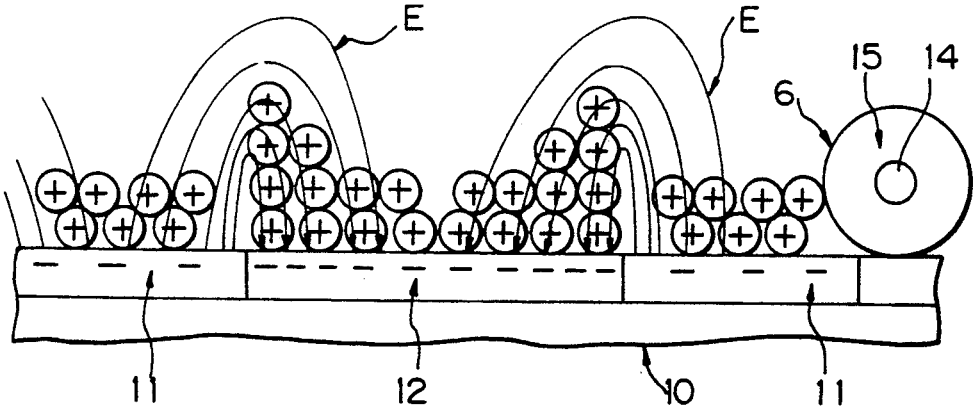

Furthermore, the first and second dielectric bodies 11 and 12 may be charged to the same polarity by friction to form numerous microfields on the surface of the developing roller 5. For example, assuming that the dielectric bodies 11 and 12 are positively charged, they may be made of substances each having a particular charging characteristic and sufficiently remote with respect to the frictional charge series. In such a case, the toner supply roller 6 to contact the developing roller 5 will be made of a substance positioned on the negative side relative to first and second dielectric bodies with respect to the frictional charge series. Despite that the two kinds of dielectric bodies are charged to the same polarity, a potential difference is developed between them due to a difference in the amount of charge, again forming microfields between the dielectric bodies. Assume that the toner is chargeable to positive polarity, that the first dielectric body 12 is made of polystyrene resin, the second dielectric bodies 11 are made of polypropyrene resin, and the toner supply roller 6 is made of polyurethane resin. Then, as shown in FIG. 6D, although the toner supply roller 6 charges both of the dielectric bodies to negative polarity, the positive toner is intensely attracted mainly by the second dielectric bodies 12 since the dielectric bodies 12 retain a greater amount of frictional charge than the dielectric bodies 11 to thereby generate microfields.

Figure 4A:
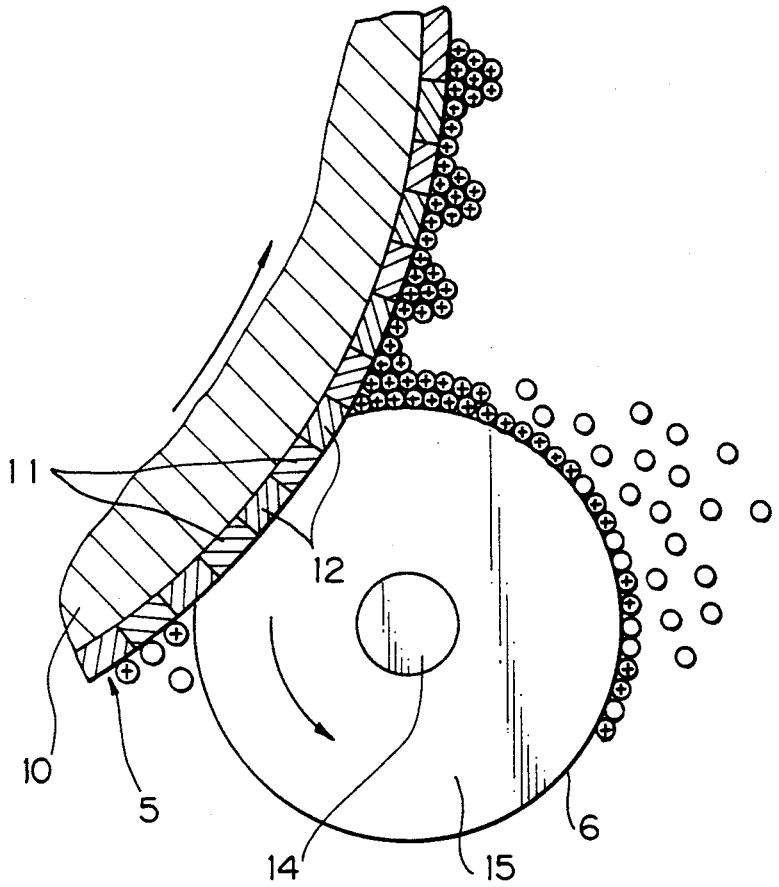
FIG. 4A is a section showing an alternative embodiment of the present invention.

FIGS. 4A–4D show a modified configuration of the developing roller 5. As shown in FIG. 4A, the developing roller 5 has a base 10 implemented as a conductive roller 10 made of aluminum, iron, copper or similar metal, and medium resistance bodies 12 and high resistance bodies 11 which are affixed to the periphery of the conductive base 10. The resistance bodies 11 and 12 are implemented by dielectric bodies having at least different resistivities, and each has a particular charging characteristic. The resistivity of the resistance bodies 12 is higher than that of the surface of the base (conductive roller 10 in the modification) while the resistivity of the resistance bodies 11 is even higher than that of the resistance bodies 12. Specifically, the resistivity of the resistance bodies 11 and 12 may be higher than $10^8$ Ωcm, preferably higher than $10^{10}$ Ωcm.

Figure 4B:
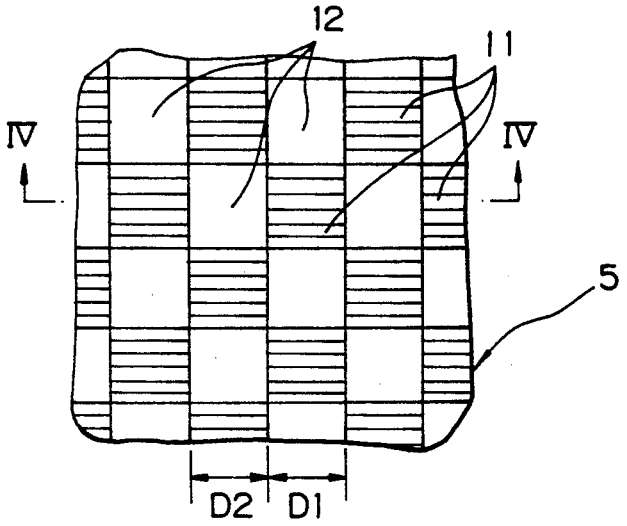
FIG. 4B is an enlarged plan view schematically showing dielectric bodies provided on a developing roller in the embodiment of FIG. 4A.
Figure 4C:
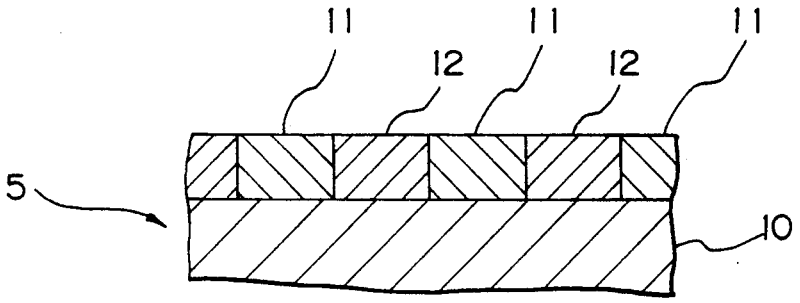
FIG. 4C is a section along line I-IV of FIG. 4B.

In FIG. 4B, as well as in FIGS. 5A–5D, the high resistance bodies 11 are provided with shadows for the distinction thereof from the medium resistance bodies 12. As shown in FIGS. 4A–4C, the high resistance bodies 11 and low resistance bodies 12 are arranged in a regular pattern (or possibly in an irregular pattern) and exposed to the outside on the surface of the developing roller 5. The shape of the resistance bodies 11 and 12 are open to choice. When the resistance bodies 11 and 12 are each provided with a rectangular shape, as shown in FIG. 4B, each side thereof D1 or D2 may range from 10–500 μm. The sizes and resistivities of the resistance bodies 11 and 12 may be suitably selected so long as they intensify the microfields, deposit an optimal amount of toner on the developing roller 5, and form a desired electric field in the developing region.

In the above modification, a positively chargeable toner is used, and the resistance bodies 11 and 12 are made of a substance chargeable to the opposite polarity to the toner, i.e., to negative polarity. If desired, a bias voltage, e.g., DC, AC, DC-superposed AC or pulse may be applied to the conductive roller 10 of the developing roller to further enhance image quality. The conductive roller 10 may be connected to ground, if necessary. This is also true with the toner supply roller 6. When the developer carrier is implemented as a belt, the two kinds of resistance bodies will be affixed to the surface of a conductive base of the belt in the previously stated arrangement. On the other hand, the foam body 15 of the toner supply roller 6 will be made of, for example, polyurethane foam.

Figure 4D:
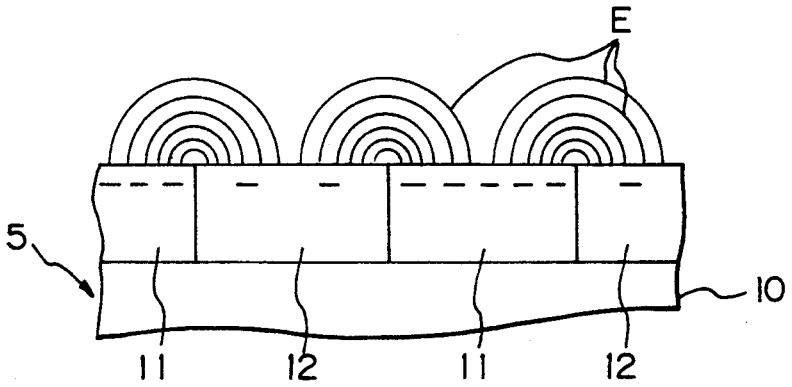
FIG. 4D is a schematic cross sectional view of the developing roller of the embodiment of FIG. 4A showing the relative degree of charging of the dielectric bodies.

In the above condition, as in the condition of FIG. 6D, despite that both of the resistance bodies 11 and 12 of the developing roller 5 are negatively charged by the toner supply roller 6, their surface potentials are different from each other since their resistivities are different, i.e., the charge of the high resistance bodies 11 is greater in amount than the charge of the medium resistance bodies 12, as schematically represented by FIG. 4D. As a result, microfields are developed between the resistance bodies 11 and 12. Specifically, numerous microfields are formed on the developing roller 5 in a uniform distribution since the numerous resistance bodies 11 and 12 are arranged on the conductive roller 10 alternately. Assuming electric lines of force representative of an electric field, electric lines of force E are formed in the space close to the surface of the developing roller 5, as indicated by a number of curves in FIG. 4D. Each electric line of force E leaves the developing roller 5 and returns to it.

The surface of each of the resistance bodies 11 and 12 has an extremely small size and, therefore, the resulting microfield is extremely small, so that the microfield is noticeably intensified by the edge effect or the fringing effect. As shown in FIG. 4A, the toner positively charged by such intense microfields are strongly attracted onto the surface of the high resistance bodies 11 and, therefore, firmly retained in a great amount on the developing roller 5. More specifically, the charged toner is restricted within the microfields by intense forces and retained on the developing roller 5 along the electric lines of force. At this instance, the toner is intensely charged due to the friction of the toner supply roller 6 and developing roller 5 and, in addition, retained on the roller 5 by the intense microfields. Therefore, when the toner on the roller 5 is regulated by the doctor blade 8 made of, for example, urethane, the toner short of charge and mixed with the sufficiently charged toner is removed by the doctor blade 8. As a result, only the sufficiently charged toner is conveyed to the developing region 9 in a greater amount than conventional. The electric field between the developing roller 5 and the belt 1 in the developing region 9 promotes easy deposition of the toner on the belt 1 due to a greater electrode effect. Consequently, the toner image has the density thereof increased and is free from contamination in the background thereof.

While FIG. 4D shows a specific case wherein only the microfields are formed over the entire surface of the developing roller 5, it is likely that electric fields different from the microfields exist together with the microfields. In any case, the intensity is increased since microfields do exist with the result that a great amount of toner is deposited on the developing roller 5.

If desired, only the high resistance bodies 11 may be charged to a predetermined polarity to form microfields between them and the medium resistance bodies 12. The gist is that at least the high resistance bodies 11 are charged to form microfields due to the difference of surface potentials.

Figure 5A:
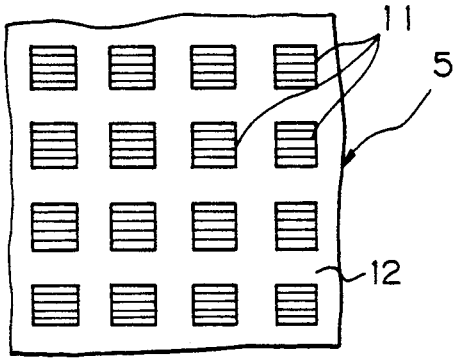
FIGS. 5A–5D are enlarged views each showing another specific arrangement of the dielectric bodies.
Figure 5B:
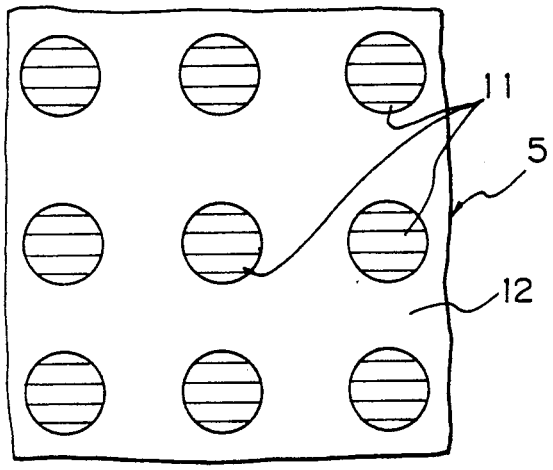
Figure 5C:
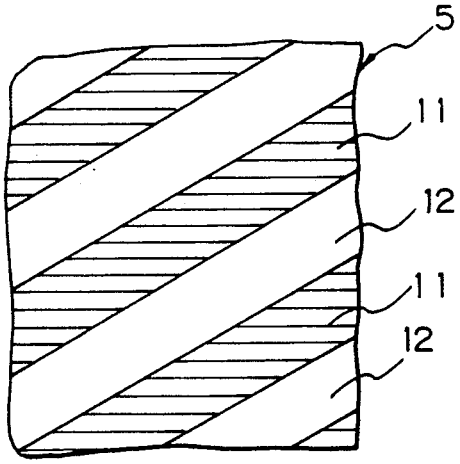
Figure 5D:
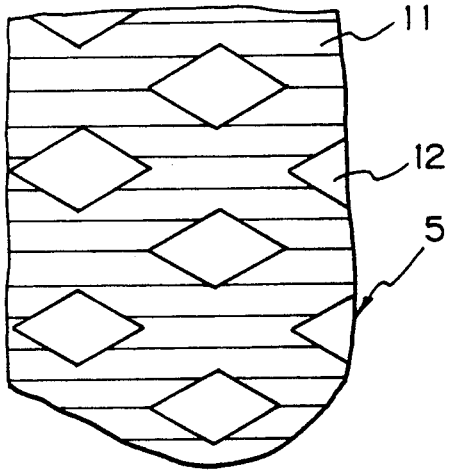

Not only the surface configurations and sizes of the resistance bodies 11 and 12 but also the arrangement thereof are open to choice. For example, as shown in FIGS. 5A and 5B, the high resistance bodies 11 having a suitable surface configuration may be distributed in the medium resistance body 12. Conversely, as shown in FIG. 5D, the medium resistance bodies 12 having a suitable configuration may be distributed in the high resistance body 11. Further, as shown in FIG. 5C, the resistance bodies 11 and 12 may be implemented as stripes alternating with each other. When the high resistance bodies 11 (or medium resistance bodies 12) has a circular surface configuration shown in FIG. 5B, they may be provided with a diameter of 10–500 μm, especially about 500–300 μm. When each high resistance body 11 is implemented as a stripe as shown in FIG. 5C, it may have a width and a distance to nearby strips which are about 10–500 μm.

The base for affixing the high resistance and low resistance bodies may be provided with a conductive layer on only the surface thereof. The conductive layer may be connected to ground, or a predetermined bias voltage may be applied to the conductive layer.

With any one of the specific configurations described above, it is possible to form microfields on the surface of the developing roller 5 by arranging two different kinds of dielectric bodies which are different from each other with respect to the frictional charge series on the surface of the roller 5 and causing the above-stated charging member to rotate in contact with the dielectric bodies. Even when the developer carrier is implemented as a belt, the same operation and effect are achievable if such dielectric bodies are arranged on a sheet-like base.

Further, in all the specific configurations shown and described, the dielectric bodies 11 and 12 are laminated on the developing roller 5 to fully cover the surface of the conductive base 10. Hence, despite the AC bias voltage or the AC-DC superposed bias voltage applied between the developing roller 5 and the belt 1, the charge is prevented from leaking between the belt 1 and the roller 5. This is successful in preventing an image from being locally blanked in the form of spots and allowing the bias voltage for development to be controlled over a broad range. It is to be noted that the dielectric bodies 11 and 12 are made of substances having a volume resistivity higher than $10^8$ Ωcm, preferably higher than $10^{10}$ Ωcm or more preferably higher than $10^{12}$ Ωcm, so that they may surely hold the charge thereon. Such substances are suitably selected in consideration of durability and other factors.

While the embodiment causes the toner supply member to play the role of a charging member at the same time to simplify the construction, the charging member may be implemented as a member independent of the toner supply member. Of course, the illustrative embodiment, as well as other embodiments, is practicable with a photoconductive element in the form of a drum in place of the photoconductive belt 1 and with a non-contact development type image forming apparatus wherein an image carrier and a developer carrier are spaced from each other.

Although the embodiment has been shown and described in relation to a developing device using a non-magnetic one-component type developer which is especially feasible for color development, it is similarly applicable to a developing device using a magnetic one-component type toner with an auxiliary agent added thereto.

Figure 10:
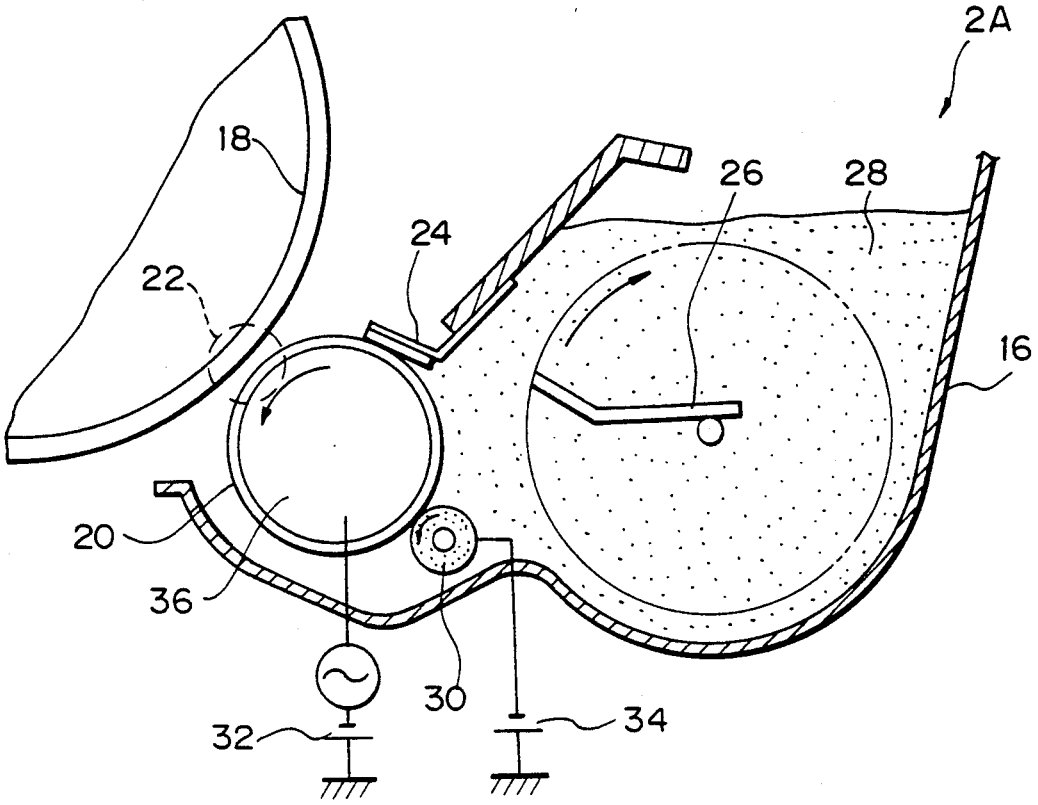
FIG. 10 is a sectional side elevation showing still another embodiment of the present invention.

Referring to FIG. 10, an alternative embodiment of the present invention is shown. As shown, a developing device 2A has a casing 16 which is formed with an opening in a position where it faces a photoconductive drum 18. A developing roller, or developer carrier, 20 is disposed in the casing 16 at a predetermined distance from the drum 18. The developing roller 20 and drum 18 face each other in a developing region 22. A blade 24 is disposed above the developing roller 20 and elastically pressed against the roller 20 for regulating the thickness of a toner layer formed on the roller 20. Specifically, while an agitator 26 and a toner supply roller 30 are rotated to feed a toner 28 from a toner reservoir formed in the casing 16, the blade 24 regulates the thickness of the toner 28. The blade 24 may be implemented by a leaf spring and a member adhered to the leaf spring and made of urethane rubber or similar material capable of charging the toner. Alternatively, the blade 24 may be constituted by a resilient member only. The blade 24 may located in either of trailing and leading positions with respect to the direction of rotation of the developing roller 20 (trailing position in the embodiment). The blade 24 may be replaced with a regulating roller or a regulating belt, if desired. The agitator 26 is rotated clockwise, as indicated by an arrow in the figure, so as to move the toner 28 to the left while agitating it.

The toner supply roller 30 may be constituted by sponge produced by causing, for example, urethane rubber to foam or by a brush polyester rubber, tetrofluoroethylene resin or similar material. The toner supply roller 30 rubs the toner 28 fed by the agitator 26 against the surface of the developing roller 20 in either of forward reverse directions to thereby supply the former to the latter. At the same time, the toner supply roller 30 scrapes off the toner 28 left on and returned by the developing roller 20 thereto. The toner 28 so supplied to the surface of the developing roller 20 is charged by the frictional charge ascribable to the friction of the rollers 20 and 30 and, therefore, electrostatically deposited on the roller 20. As a result, the toner 28 is conveyed by the developing roller 20 to the developing region 22 where the roller 20 faces the drum 18 while having the thickness thereof regulated by the blade 24.

The developing roller 20 and the toner supply roller 30 are respectively connected to power sources 32 and 34 to be applied with respective bias voltages. A bias voltage may also be applied to the blade 24, if desired. The toner 28 is transferred from the developing roller 20 to a latent image electrostatically formed on the drum 18 in an amount matching the latent image, while the bias voltage is applied to the roller 20. As a result, the toner develops the latent image to produce a corresponding toner image. The developing roller 20 substantially does not contact the drum 18, i.e., the former is located at a distance of 30–500 μm, preferably 50–250 μm, from the latter. This eliminates the need for a heavy torque as would be indispensable in the event of contact development, thereby allowing a miniature motor to be used. To further reduce the torque, the developing roller 20 may be rotated at the same peripheral speed as the drum 18.

For the bias voltage for development to be applied to the developing roller 20, use may be made of a combination of DC and AC electric fields. Regarding the AC electric field, a pulse electric field having a rectangular waveform may be set in a frequency range of 500–1500 Hz, preferably 500–1500 Hz, and the duration of a high voltage portion and that of a low voltage portion may each be provided with a different ratio to the duration of one cycle. Then, the resulting image will have desirable sharpness in a low voltage portion and desirable image density in a high voltage portion and, in addition, will suffer from a minimum of contamination in the background. The optimal ratio between the durations of the high voltage and low voltage portions, i.e., optimal duty ratio depends on the polarity of the latent image and that of the toner 28. Assuming that a negatively charged latent image is developed by a negatively charged toner 28 by reversal development, for example, the ratio between the duration of a high voltage portion (above −100 V) and the duration of a low voltage portion (below −800 V) may be selected to be 5–18-:2–8. In the event of regular development, as distinguished from reversal development, such a ratio may be reversed. The resulting image will also have desirable sharpness in a low voltage portion and a desirable image density in a high density portion and, in addition, suffer from a minimum of contamination in the background.

Figure 11:
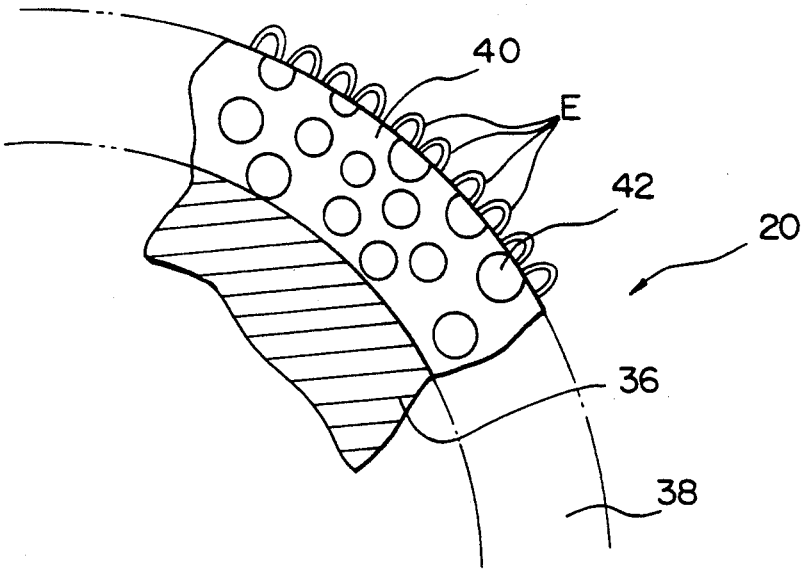
FIG. 11 is a section schematically showing the surface of a developing roller included in the embodiment of FIG. 10.

FIG. 11 shows a specific configuration of the developing roller 20. As shown, the roller 20 is made up of a conductive base 36 and a surface layer 38 provided on the conductive base 36 and implemented by a conductive material having insulating particles dispersed therein. Specifically, insulting particles are distributed in a conductive portion 40 of the surface layer 38 and partly exposed to the outside on the surface of the roller 20. The conductive portion 40 may be made of a substance having a resistivity less than $10^{12}$ Ωcm, preferably $10^{8}$ Ωcm, e.g., organic polymer to which an agent for providing conductivity is added. The organic polymer may be selected from resins (plastomers) and rubbers (elastomers). The agent for producing conductivity may be selected from metal powders, carbon black, conductive oxides, non-electrolytic platings, graphite, metal fibers, and carbon fibers. When the conductive portion 40 is made of an elastomer, the surface layer 38 will have elasticity and easily contact the drum 18 which is rigid, thereby promoting easy contact type development. In this respect, a conductive elastomer is especially desirable.

On the other hand, the insulating particles have a resistivity higher than $10^{13}$ Ωcm, preferably higher than $10^{14}$ Ωcm, and the average particle size is preferably greater than 5 μm. Should the average particle size be less than 5 μm, it would be difficult to form the microfields and, therefore, to effect stable toner deposition and charging. The insulating particles may be amorphous or not and may be implemented as particles of alumina or similar inorganic substance or epoxy resin or similar organic substance.

When the conductive portion 40 is constituted by the above-mentioned conductive elastomer, it is preferable to implement the insulating particles by an elastomer to further reduce the hardness of the conductive material. The insulating particles of elastomer may be produced by any conventional methods, e.g., a method which freezes an elastomer by dry ice and then pulverizes it or a method which forms an aqueous emulsion by use of, for example, a surface active agent and then hardens it. The amount in which the insulating particles are added to the conductive material is suitably selected within the range of 10–200 Wt % for 100 Wt % of conductive material. The total area of the insulating particles exposed to the outside on the surface of the roller 20 should preferably lie in the range of 20–60%.

A specific procedure for fabricating the roller 20 having the above construction is as follows. First, the insulating particles are added to the conductive material by a conventional dispersion system implemented with, for example, a ball mill or kneading. The resulting mixture is molded on a conductive base, typically a SUS, iron, aluminum or similar metallic roller, by injection molding, extrusion molding, spray coating, dipping or similar technology. Thereafter, the surface of the roller 20 is ground to have a smooth surface. To enhance the bond between the conductive material and the conductive base, use may be made of a plastomer, preferably a conductive plastomer.

The roller 20 was actually fabricated by the following sequence of steps. A painting liquid was prepared by using 100 Wt % of conductive paint (Electrodag 440 available from Japan Atison (70% of solid; acryl resin containing nickel particles)), 50% of acryl resin (average particle size of 80 μm), and 200 Wt % of diluent (SB-1 also available from Japan Atison). Such a mixture is applied to a SUS metallic roller by spray coating, dried at 80° C. for 1 hour, and then ground to produce a roller having a 100 μm thick surface layer.

The insulating particles exposed on the surface of the developing roller 20 are charged to the opposite polarity to the toner 28, i.e., to positive polarity by the toner supply roller. On the other hand, the toner 28 being conveyed toward the developing roller 20 in contact with the toner supply roller 30 is charged to negative polarity. On reaching the developing roller 20, the toner 28 is further negatively charged by the contact thereof with the roller 20, particularly the insulating portions 42, and electrostatically deposited on the roller 20. At this instant, since the insulating portions 42 are positively charged and the conductive portion 40 adjoins the insulating portions 42, a positive charge is deposited only on the numerous insulating portions 42. As a result, as shown in FIG. 11, a closed electric field is developed between each insulating portion 42 and the conductive portion 40, i.e., numerous microfields E are developed in the vicinity of the surface of the roller 20. Assuming electric lines of force representative of a field condition, numerous electric lines of force extending out from the developing roller 20 and returning to the roller 20 are formed in the space adjoining the surface of the roller 20, as indicated by curves in FIG. 11. Consequently, the microfield E is developed between each insulating portion 42 and the conductive portion 40.

Since the insulating portions 42 each has an extremely small area, the microfield E is noticeably intensified by the fringing effect. The negatively charged toner 28 is strongly attracted onto the insulating portions 42 by such microfields E and firmly retained thereon. While the blade 24 regulates the thickness of the toner deposited on the developing roller 20, it removes part of the toner which is short of charge in contact therewith. Consequently, only the sufficiently charged toner 28 is conveyed to the developing region 22 by the developing roller 20.

In the developing device 2A, the developing roller 20 and toner supply roller 30 are free from charge-up due to the arrangement of the conductive portion 40 and insulating portions 42 on the surface of the roller 20. This is presumably because the insulating portions 42 and the conductive portion 40 respectively charge and discharge the toner, maintaining a balanced charge condition as a whole. It is considered that the pulse electric field having a rectangular waveform and implementing the bias for development acts on the microfields E and the charged toner 28 to give desirable dynamic energy for development.

Hereinafter will be described a more specific embodiment of the present invention.

In this embodiment, the drum 18 is made of OPC and provided with a surface potential of −900 V in the background and a potential of −100 V in the exposed area. The developing roller 20 is spaced apart from the drum 18 by a distance of 100 μm for effecting reversal development. The insulating portions 42 contacting the toner supply roller 30 hold a charge which sets up a potential of +200 V with respect to the ground potential, whereby the negatively charged toner 28 is deposited on the roller 20 in an amount of about 1.0–1.2 $mg/cm^2$. A power source applies to the developing roller 20 a pulse voltage having a P—P voltage of 1000 V, maximum potential of 0 V, frequency of 500 Hz, and duty ratio of 30% ($T_2/T_1$).

Figure 12A:
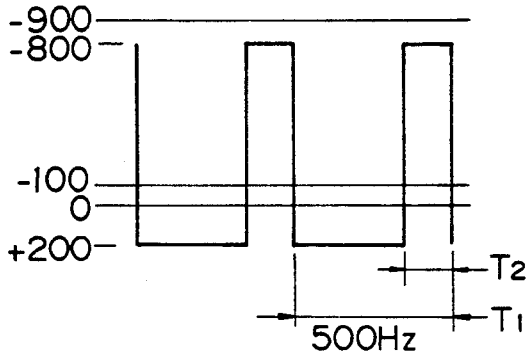
FIGS. 12A and 12B each shows the variation of a potential deposited on a particular portion of the developing roller shown in FIGS. 10 and 11.
Figure 12B:
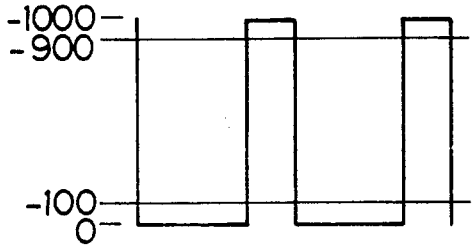

FIGS. 12A and 12B show respectively the variation of the surface potential of insulating portions 42 with respect to time and the variation of the surface potential of the conductive portion 40, taking the ground potential as a reference. In these figures, there are shown the level of the background surface potential of the drum 18 (−900 V) and the level of the surface potential of the exposed area (−100 V). The surface potential of the insulating portions 42 is offset by +200 V due to the charge held by the voltage from the power source 32, as indicated by a rectangular continuous line shown in FIG. 12A. On the other hand, the surface potential of the conductive portion 40 is identical with the voltage from the power source 32, as indicated by a rectangular continuous line in FIG. 12B.

Hereinafter will be described an electric field to appear between the developing roller 20 and the drum 18 in association with the variations of the potentials on the roller 20. The electric field differs from the insulating portions 42 to the conductive portion 40 of the developing roller 20 and from the image area to the background of the drum 18.

Figure 13A:
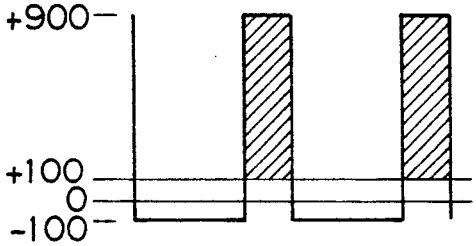
FIGS. 13A and 13B each shows the variation of an electric field for development formed on a conductive portion included in the developing roller shown in FIGS. 10 and 11 under a particular condition.
Figure 13B:
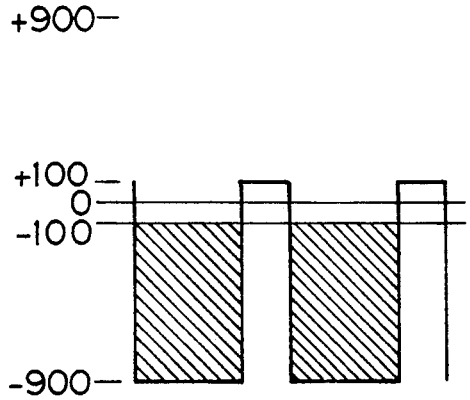
Figure 14A:
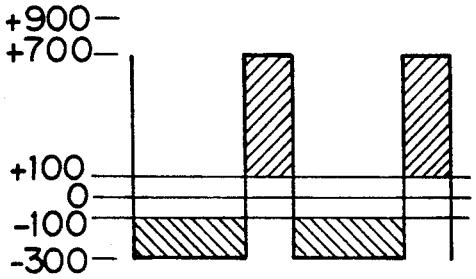
FIGS. 14A and 14B each shows the variation of an electric field for development formed on insulating portions also included in the developing roller of FIGS. 10 and 11.
Figure 14B:
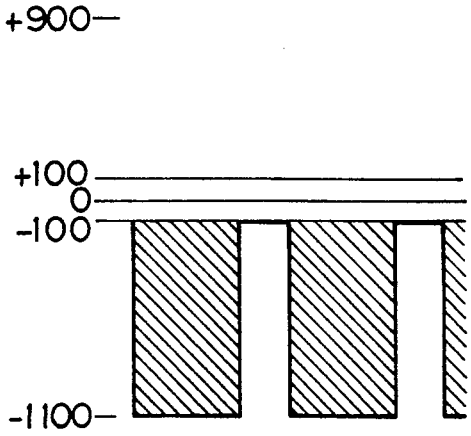

FIGS. 13A and 13B illustrate the electric field on the conductive portion 40 whose surface potential varies as shown in FIG. 12B. Specifically, FIG. 13A shows the variation of potential difference between the conductive portion 40 and the drum 18 occurring when the conductive portion 40 faces the image area (exposed area) of the drum 18. FIG. 13B shows the variation of potential difference between the conductive portion and the drum 18 occurring when the former faces the background (unexposed area) of the latter. FIGS. 14A and 14B pertain to the electric field on the insulating portions 42 which varies as shown in FIG. 12A. Specifically, FIG. 14A shows the variation of potential difference between the insulating portions 42 and the drum 18 observed when the former faces the image area (exposed area) of the latter, while FIG. 14B shows the variation of the potential difference between the insulating portions 42 and the drum 18 observed when the former faces the background (unexposed area) of the latter.

The electric field exerts an electrostatic force on the toner carried on the surface of the developing roller 20 or the surface of the drum 18. For this reason, in the above figures, the potential difference corresponding to the electric field which moves the toner toward the drum 18 and the potential difference corresponding to the electric field which moves it toward the developing roller 20 are represented by a positive sign and a negative sign, respectively, in order to distinguish the directions of the electrostatic force. Experiments showed that the threshold of the potential difference transferring the toner from the developing roller 20 to the drum 18 and the threshold of the electric field transferring it from the drum 18 to the developing roller 20 are respectively +100 V and −100 V, as indicated by horizontal lines in the above figures. Hatching indicates portions corresponding to an electric field which contributes to the toner transfer beyond the thresholds.

For the above experiments, the developing roller 20 and the drum 18 were spaced apart by a gap of 100 μm, and a DC voltage was applied to the roller 20 and changed to see the transfer of the toner. In this specific case, the threshold of the electric field for development was measured to be 1 V/μm while the charge deposited on the toner was found to be about 10 μC/g.

Presumably, when the toner existing on the conductive portion 40 of the developing roller 20 faces the image area of the drum 18, it is transferred toward the drum 18 when an electric field for developing corresponding to a potential difference of +900 V is set up, as indicted by hatching in FIG. 13A. When such a toner faces the background of the drum 18, it presumably is transferred to the developing roller 20 when the electric field for development reaches −900 V, as indicated by hatching in FIG. 13B. Likewise, when the toner 28 existing on the insulating portions 42 faces the image area of the drum 18, a negative electric field of −300 V and a positive electric field of −700 V appear alternately, as indicated by hatching in FIG. 14A, since the portions 42 are originally charged to +200 V. Presumably, such a toner is transferred from the developing roller 20 to the drum 18 by the positive electric field and from the drum 18 to the developing roller 20 by the negative electric field. When the toner on the insulating portions 42 faces the background of the drum 18, it presumably is transferred from the drum 18 to the developing roller 20 by a negative electric field of −1100 V and not transferred back and forth between the drum 18 and the roller 20.

As stated above, the transfer of the toner 28 carried on the developing roller 20 is selectively controlled by the electric field developed on the roller 20.

The above-described image was compared with an image produced by a developing roller having a simple aluminum surface and the electric field shown in FIGS. 13A and 13B. The comparison showed that the former is free from contamination in the background thereof and sufficiently high in density and, in addition, insures high reproducibility of lines, compared to the latter. With a developing roller having such a simple aluminum surface, reproducibility comparable with the reproducibility of the embodiment could not be attained without lowering the image density.

In the illustrative embodiment, the surface of the developing roller 20 include portions where a different bias for development acts. Hence, when a bias is applied between the drum 18 carrying a latent image and the roller 20 carrying the toner in order to effect development, the transfer of the toner can be selectively controlled by the roller 20. This is presumably why the above advantages are achievable. Specifically, positive and negative electric fields exceeding respective thresholds as shown in FIG. 14A act on the toner 28 existing in the insulating portions 42, preventing an excessive amount of toner deposition. On the other hand, the toner existing in the conductive portion 40 has a higher developing ability than the toner in the insulating portions 42, as FIG. 13A indicates. This, coupled with the fact that this portion 40 is conductive, suppresses the edge effect to thereby render the image density uniform.

More specifically, the developing roller 20 of the embodiment has both of the characteristics of two different types of developing rollers, i.e., a roller having an insulating surface and a roller having a conductive surface. A roller with an insulating surface has high reproducibility of lines and high tonality although image density available therewith is low, but the reproducibility and tonality would be lowered if the density were increased. A roller with a conductive surface is inferior to the roller with an insulating surface in reproducibility and tonality although a high density image with uniform solid image portions is attainable due to the electrode effect. Since the conductive portion 40 and insulating portions 42 are arranged at random, the resulting image is free from a moire pattern even when the relative speed difference between the drum 18 and the roller 20 is zero. Rather, the image in such a condition appears as if a halftone area and a high density area thereof were subjected to dot processing and, therefore, achieves high quality.

While the embodiment charges the insulating portions 42 to the opposite polarity to the toner, the material constituting the surface of the toner supply roller 30 may be so selected as to charge the portions 42 to the same polarity as the toner. This is also successful in forming microfields due to the potential difference between the insulating portions 42 and the conductive portion 40 and causes the toner to deposit mainly on the conductive portion 40.

In summary, it will be seen that the present invention provides a developing device which enhances image density while preserving tonality and, therefore, insures high image quality by depositing an adequate amount of developer on a latent image electrostatically formed on an image carrier. Further, the developing device frees an image from a moire pattern and, therefore, allows the relative speed of the image carrier and a developer carrier to be reduced to zero for effecting equispeed development. Even when the pattern of a field arrangement appears in the resulting image, the image achieves high quality with the halftone portion and high density area thereof appearing as if having undergone dot processing.

Various modifications will become possible for those skilled in the art after receiving the teachings of the present disclosure without departing from the scope thereof.

What is claimed is:

1. A developing device incorporated in an image forming apparatus for developing a latent image electrostatically formed on an image carrier by a developer in a developing region, said device comprising:

bias applying means for applying a bias to said developing region; and a developer carrier for transporting the developer, said developer carrier having a first and a second substance different in charging characteristic from each other and exposed to the outside on the surface of said developer carrier in a regular or irregular pattern, said first and second substances being dielectric materials, and at least one of said first and second substances being charged to a predetermined polarity on said surface of said developer carrier to form a great number of microfields on said surface of said developer carrier;

the movement of the developer being controlled by an electric field determined by a relation of a potential deposited on said image carrier, an electric field ascribable to the bias applied from said bias applying means, and an electric field developed on said developer carrier.

2. A device as claimed in claim 1, wherein the developer is deposited on said developer carrier by said microfields.

3. A device as claimed in claim 1, wherein the bias applied to said developing region forms an alternating electric field.

4. A device as claimed in claim 1, wherein said first and second substances are charged to opposite polarities to each other on the surface of said developer carrier to form said microfields on said surface of said developer carrier.

5. A device as claimed in claim 1, wherein only one of said first and second substances is charged to a predetermined polarity to form said microfields on the surface of said developer carrier.

6. A device as claimed in claim 1, wherein said first and second substances are charged to different potentials of the same polarity to form said microfields on the surface of said developer carrier.

7. The device as claimed in claim 1, wherein said bias applying means applies a bias potential to a conductive base of said developer carrier.

8. The device as claimed in claim 1, wherein said developer carrier and said image carrier are in frictional contact with each other.

9. The device as claimed in claim 1, wherein said developer carrier and said image carrier are provided in close proximity such that a small gap exists between their respective surfaces.

10. The device as claimed in claim 1, wherein said first dielectric material is a polystyrene resin and the second dielectric material is a silicone resin.

11. The device as claimed in claim 1, wherein said first dielectric material is a polystyrene resin and said second dielectric material is a polycarbonate resin.

12. The device as claimed in claim 1, further comprising a toner supply roller for charging the developer by frictional contact therewith.

13. The device as claimed in claim 12, wherein a second bias supplying means is provided for applying a bias potential to a conductive core of said toner supply roller in order to control the intensity of the microfields formed on the surface of said developer carrier.

14. The device as claimed in claim 12, wherein said toner supply roller has an outer foam body which elastically deforms upon frictional contact with the developer carrier.

15. A developing device incorporated in an image forming apparatus for developing a latent image electrostatically formed on an image carrier by a developer in a developing region, said device comprising:

bias applying means for applying a bias to said developing region; and a developer carrier for carrying the developer, said developer carrier having a conductive base and a surface layer provided on said conductive base and constituted by a conductive substance in which insulating particles are dispersed, at least said insulating particles being charged on the surface of said developer carrier to form a number of microfields on said surface of said developer carrier;

the movement of the developer being controlled by an electric field determined by a potential deposited on said image carrier, an electric field ascribable to the bias applied by said bias applying means, and an electric field developed on said developer carrier.

16. A device as claimed in claim 15, wherein the developer is retained on said developer carrier by said microfields.

17. A device as claimed in claim 16, wherein the bias applied to said developing region forms an alternating electric field.

* * * * *